US007290339B1

(12) United States Patent
Schmelzer

(10) Patent No.: US 7,290,339 B1
(45) Date of Patent: Nov. 6, 2007

(54) CUTTING APPARATUS FOR EASILY OPENING PLASTIC PACKAGING

(76) Inventor: Mark J. Schmelzer, 237 N. Columbus St., Somerset, OH (US) 43783

( * ) Notice: Subject to any disclaimer, the term of this patent is extended or adjusted under 35 U.S.C. 154(b) by 35 days.

(21) Appl. No.: 11/388,480

(22) Filed: Mar. 24, 2006

(51) Int. Cl.
*B67B 7/00* (2006.01)
*B26B 13/00* (2006.01)

(52) U.S. Cl. ..... 30/2; 30/265; 30/263; 30/267; 30/268; 30/269

(58) Field of Classification Search ..... 30/2, 30/97, 101, 263–270, 422, 426, 427; 81/360
See application file for complete search history.

(56) References Cited

U.S. PATENT DOCUMENTS 1,031,578 A * 7/1912 Palis ..... 30/265
1,422,901 A * 7/1922 Terry ..... 83/430
1,607,010 A * 11/1926 Madsen ..... 30/265
2,114,364 A * 4/1938 Kilbride et al. ..... 409/296
4,283,853 A * 8/1981 Fazzini ..... 30/265
4,847,997 A * 7/1989 Petty ..... 30/95
5,099,577 A * 3/1992 Hutt ..... 30/101
5,581,886 A * 12/1996 Sesser et al. ..... 30/101
6,237,449 B1 * 5/2001 Orlosky ..... 81/360

OTHER PUBLICATIONS

"OPENX", offered for sale by "Ranchmark, Inc.",retrieved from <url: http://www.myopenx.com/>, on Jan. 2, 2006.

* cited by examiner

*Primary Examiner*—Joseph J. Hail, III
*Assistant Examiner*—Robert Scruggs
(74) *Attorney, Agent, or Firm*—Ronald J. Koch

(57) ABSTRACT

A cutting apparatus for easily opening plastic packaging comprises: first support member 100, second support member 200, first shaft 400, second shaft 401, third shaft 402, first cutting wheel 300, second cutting wheel 301, third cutting wheel 302, handle 303, first drive wheel 304, and a second drive wheel 305.

16 Claims, 6 Drawing Sheets

CUTTING APPARATUS FOR EASILY OPENING PLASTIC PACKAGING

BACKGROUND ON THE INVENTION

1. Field of Invention

This invention relates to package openers, specifically to openers used to gain access to the contents of clamshell, blister, and other similar packaging.

2. Prior Art

Many products today come in theft deterrent plastic packaging that is difficult to open. Such packaging includes blister or clamshell packaging. With blister packaging, the plastic is adhered to cardboard. With clamshell packaging, the two halves are attached to each other with a welded flange. This type of packaging possesses noticeable thickness and is heat sealed around the edges thereby making it nearly impossible to open—either by tearing with one's hands or using a pair of scissors, razor blade, or other instrument.

When scissors are used to open the package two common problems occur. The first problem is that a large amount of force has to be applied to the handles of the scissors in order to pierce the packaging. The second common problem is that the scissors "dent" the packaging instead of piercing, which results in the package remaining unopened and the contents possibly damaged. In addition, when the packaging is dented, a large amount of stress is placed on the scissor blades and the pivot to which they are attached. This stress could cause the scissors to fail and injure the user.

When a razor blade is used, the user is often required to stab the packaging with a forceful downward motion. This could result in the failure of the blade or cause the blade to deflect off the package, both of which could injure the user. Additionally, in order to achieve the force necessary to penetrate the package without using a downward motion, the user is often required to pull the blade toward himself or herself which also increases the likelihood of injury. It is therefore desirable to have an invention that facilitates the opening of these packages while eliminating the foregoing undesirable effects.

OBJECTS AND ADVANTAGES

Accordingly, several objects and advantages of the present invention are:

to provide a device to open packages with a minimum amount of force, to provide a device to open packages that is self-feeding, to provide a device to open packages that is not dangerous to the user, to provide a device to open packages that is easy to operate, to provide a device to open packages that does not crimp the package, to provide a device to open packages that provides a clean and precise cut, to provide a device to open packages that is inexpensive, and to provide a device to open packages that does not have any sharp surfaces.

Further objects and advantages are to provide a device that can be precisely controlled for opening plastic packages containing delicate items and provide a device that can be used repeatedly over an extended period of time. Still further objects and advantages will become apparent from a consideration of the ensuing description and drawings.

SUMMARY

In accordance with the present invention, a plastic package opener comprises a frame with two members pivotably joined at one end capable of locking in place, a cutting wheel on the first member, a slotted feed wheel on the second member, and a handle to rotate the feed wheel.

REFERENCE NUMERALS IN DRAWINGS

Figure 1:
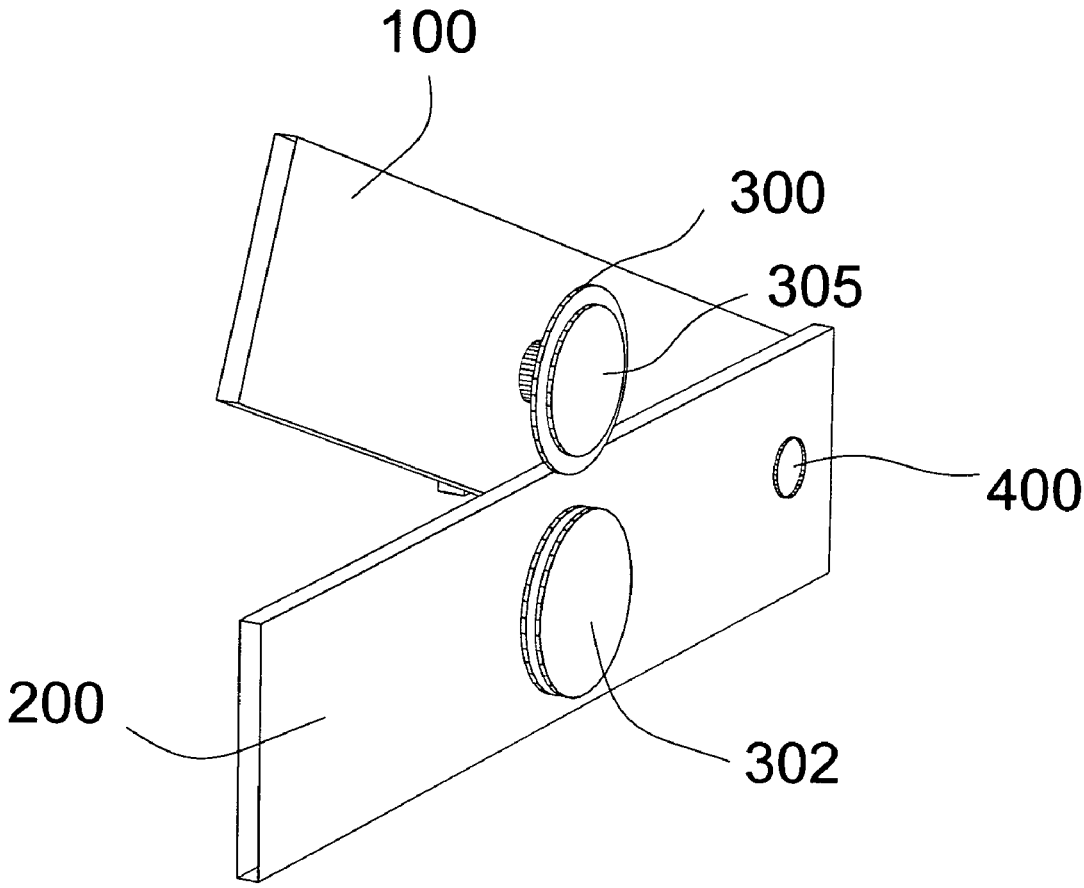
FIG. 1 is a perspective front view.
Figure 2:
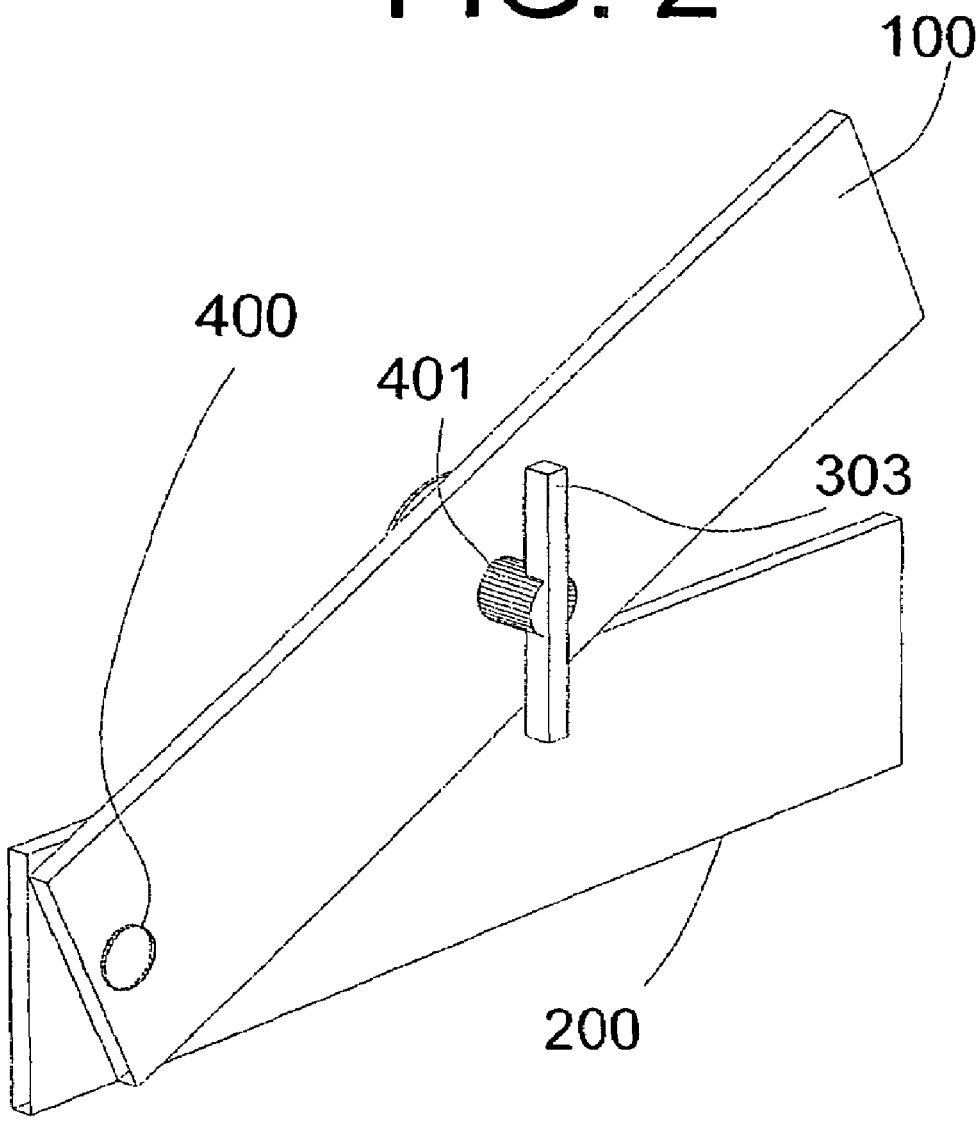
FIG. 2 is a perspective rear view.
Figure 3:
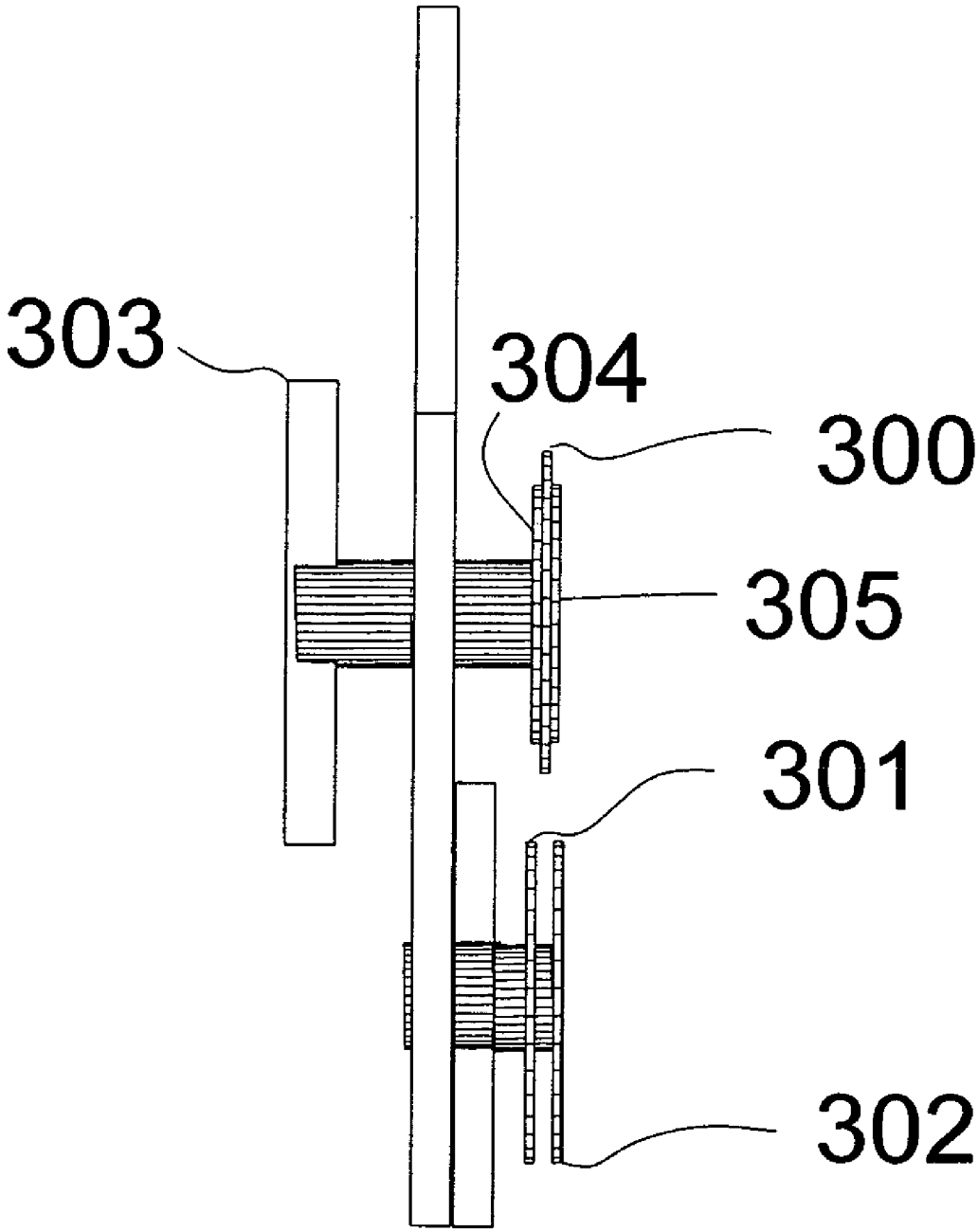
FIG. 3 is a side view.
Figure 4:
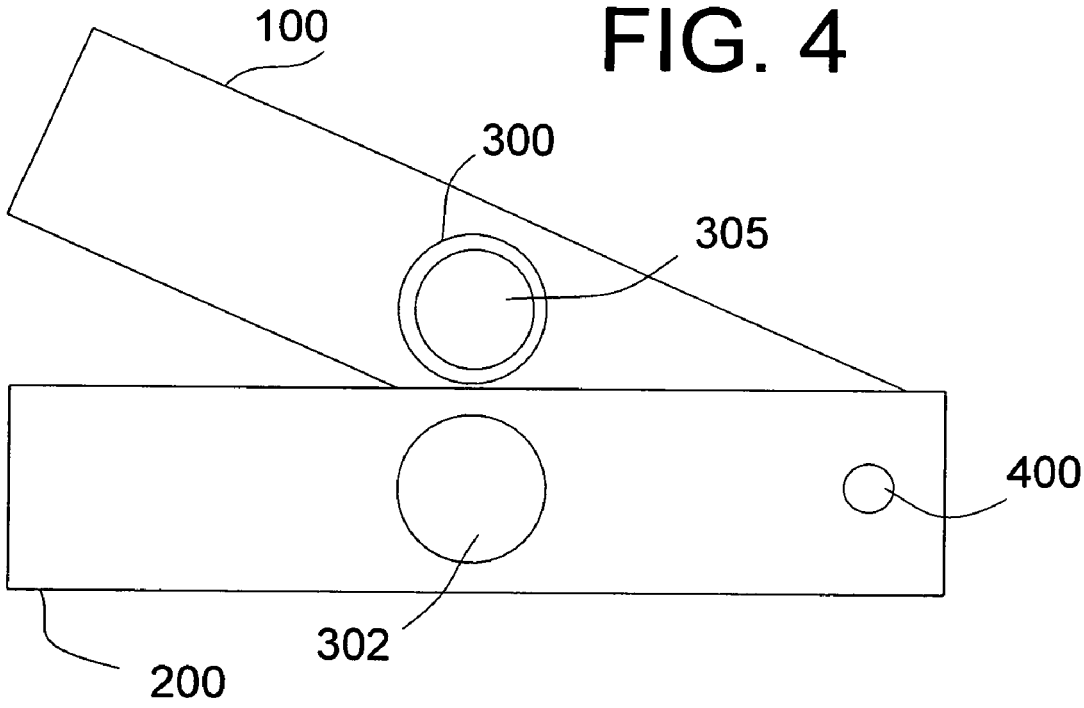
FIG. 4 is a frontal view.

The table below lists the reference numerals employed in the figures, and identifies the element designated by each numeral.

10 Clamshell Package 10
11 Flange 11
12 Container 12
100 First Support Member 100
200 Second Support Member 200
300 First Cutting Wheel 300
301 Second Cutting Wheel 301
302 Third Cutting Wheel 302
303 Handle 303
304 First Drive Wheel 304
305 Second Drive Wheel 305
400 First Shaft 400
401 Second Shaft 401
402 Third Shaft 402

DETAILED DESCRIPTION

Referring to FIGS. 1 through 6, a cutting apparatus for easily opening plastic packaging comprises: first support member 100, second support member 200, first shaft 400, second shaft 401, third shaft 402, first cutting wheel 300, second cutting wheel 301, third cutting wheel 302, handle 303, first drive wheel 304, and a second drive wheel 305.

The first support member 100 is elongate and has proximal, distal, and middle portions, is substantially rigid, and has an aperture in the middle portion. The second support member 200 is elongate and has proximal, distal, and middle portions, and is substantially rigid.

Means for pivotably connecting the proximal portion of the second support member 200 to the proximal portion of the first support member 100 comprises the proximal portion of the first support member has an aperture, the proximal portion of the second support member has an aperture, the apertures of the first and second proximal portions are coaxially aligned, a first shaft 400 is positioned through the apertures of the first and second support members. Thus, the first and second support members are pivotably connected.

The second shaft 401 is rigid, and elongate, has a longitudinal axis through the center thereof, has a proximal and a distal end, and a middle portion.

The first cutting wheel 300 is disk shaped, rigid, has a center portion, and has a transverse axis through the center portion. The second cutting wheel 301 is disk shaped, rigid, has a center portion, and has a transverse axis through the center portion. The third cutting wheel 302 is disk shaped, rigid, has a center portion, and has a transverse axis through the center portion.

The first drive wheel 304 is disk shaped, rigid, has a center portion, and has a transverse axis through the center portion. The second drive wheel 305 is disk shaped, rigid, has a center portion, and has a transverse axis through the center portion.

The handle 303 is securedly attached to the distal end of the second shaft 401. It is understood that the purpose of the handle 303 is to facilitate the rotation of the second shaft 401. Therefore, it will be obvious to those in the art that the handle 303 could be eliminated provided the shaft 401 would be suitable for gripping and rotating. This task could be accomplished by adhering rubber to the end of the shaft 401 to facilitate gripping, etc.

The first cutting wheel 300, first drive wheel 304, and second drive wheel 305 are coaxially aligned about their center portions. They are coaxially aligned with the longitudinal axis of the second shaft 401.

A combination is formed by the first cutting wheel 300 being sandwiched between the first and second drive wheels 304, 305. The combination is securedly attached to the proximal end of the second shaft 401. The first cutting wheel 300, first drive wheel 304, and second drive wheel 305 may be securedly attached to the second shaft 401 by inserting a threaded screw through their centers and into a threaded hole in the second shaft. Any other suitable method may be used provided the combination can rotate as the handle 303 is rotated.

Means for rotatably securing the middle portion of the second shaft 401 within the aperture in the middle portion of the first support member 100 comprises using an annular bearing assembly. In an alternative embodiment, a firm, frictional fit is used. As will be further described below, it is understood that the purpose of the second shaft 401, first cutting wheel 300, first and second drive wheels 304, 305 is that the drive wheels and the cutting wheel all rotate as the handle is turned. Therefore, any method of rotatably securing the middle portion of the second shaft 401 within the aperture in the middle portion of the first support member 100 may be used so long as the desired function is achieved.

The third shaft 402 is rigid and elongate, has a longitudinal axis through the center thereof, and has a proximal and a distal end, and a middle portion.

The second and third cutting wheels 301, 302 are in rotatable connection with the middle portion of the second support member 200. It is preferred that the second cutting wheel 301 and the third cutting wheel 302 rotate freely. As will be described elsewhere, as the first cutting wheel 300 (with or without the first and second drive wheels 304, 305) is rotated, a force is applied to the flange 11 of a plastic container 10 (FIG. 6) that pulls it into the rotating cutting wheels. Any suitable method of allowing the first and second cutting wheels to rotate may be used.

In one embodiment, the distal end of the third shaft 402 is rotatably attached to the middle portion of the second support member 200, the second cutting wheel 301 and the third cutting wheel 302 are securedly attached to the proximal end of the third shaft 402. The second and third cutting wheels 301, 302 are coaxially aligned about their center portions, and are coaxially aligned with the longitudinal axis of the third shaft 402. Thus, the shaft and cutting wheels rotate freely.

In one embodiment, second cutting wheel 301 has an aperture through the center thereof. The second and third cutting wheels 301, 302 are securedly attached to the third shaft 402 by inserting third shaft 402 into the aperture in second cutting wheel 301. Third cutting wheel 301 is then securedly attached to the proximal end of third shaft 402.

The second cutting wheel 301 and third cutting wheel 302 may be spaced apart by including a spacer between them. Alternatively, the second cutting wheel 301 may have an aperture through which the third shaft 402 may be inserted. It will be apparent to those in the art that the method of spacing the cutting wheels apart will depend on whether the rotation is achieved by the shaft rotating or the cutting wheels rotating. Regarding the former, second cutting wheel 301 can be fixed with respect to the shaft. Regarding the latter, second cutting wheel 301 will rotate with respect to the shaft.

In another embodiment, the distal end of the third shaft 402 is securedly attached to the middle portion of the second support member 200, the second cutting wheel 301 and the third cutting wheel 302 are rotatably attached to the proximal end of the third shaft 402. The second and third cutting wheels 301, 302 are coaxially aligned about their center portions, and are coaxially aligned with the longitudinal axis of the third shaft 402. In this embodiment, second and third cutting wheels 301, 302 rotate freely about third shaft 402 which is securedly attached. Thus, the shaft is stationary and the cutting wheels rotate.

It will be apparent to those skilled in the art that third shaft 402 may be securedly attached to the middle portion of second support member 200 by having an aperture in the middle portion of second support member 200 through which the third shaft 402 is inserted. The shaft may be either securedly or rotatably mounted using the methods described herein.

Figure 5:
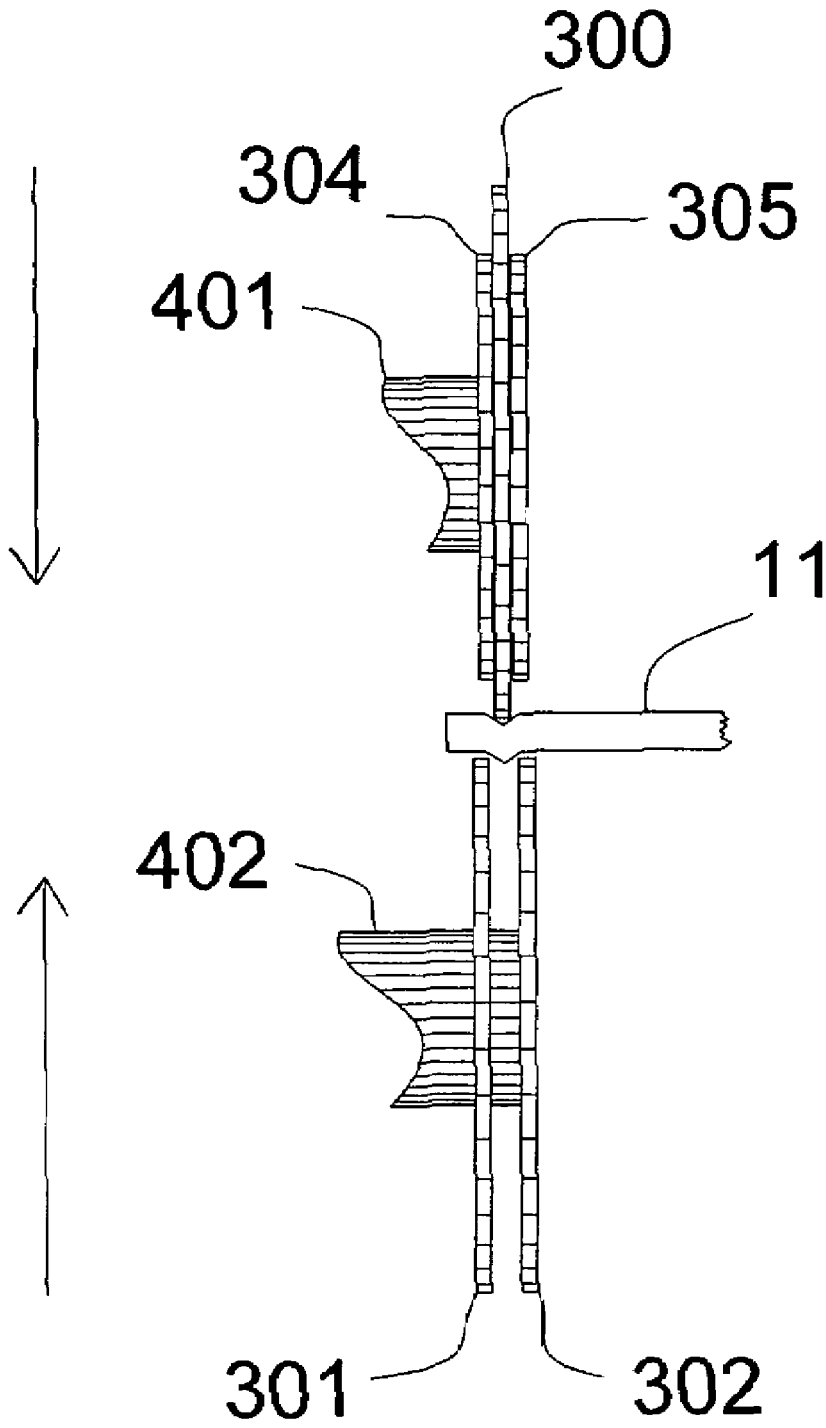
FIG. 5 is a fragmentary side view of the cutting and feed wheels as they engage each other with the flange of a plastic container between them.

The second cutting wheel 301 and third cutting wheel 302 are spaced apart so that first cutting wheel 300 can fit in between them. Referring to FIG. 5, first support member 100 and second support member 200, being pivotably attached, are rotated towards each other. This causes first cutting wheel 300 to draw closer to second cutting wheel 301 and third cutting wheel 302. The flange 11 of a plastic container 10 is positioned between the cutting wheels and is engaged by them. As force is applied, the cutting wheels pierce, or lacerate, the flange thereby making a cut.

In one preferred embodiment, first and second drive wheels 304, 305 are used. If first and second drive wheels 304, 305 are used they also engage the flange. As first cutting wheel 300 penetrates through the flange, the drive wheels are drawn downward and engage the flange. Their purpose is to pull the flange into the cutting wheels as the handle 303-second shaft 401 assembly is rotated. This is facilitated by having the drive wheels 304, 305 have added gripping or frictional capabilities. This added gripping functionality can be accomplished by having the outer periphery of the drive wheels be scored or notched. The outer periphery could also be coated with rubber or any similar material.

It will be apparent to those in the art that the cutting wheels 300, 301, and 302 could also have the periphery notched. However, the cutting wheels must also have the ability to pierce the plastic flange.

It will be apparent to those in the art that the drive wheels are not essential. Therefore, first cutting wheel 300 may alone engage second and third cutting wheels 301, 302 on opposite sides of the flange of a plastic container. In this embodiment, having the outer periphery of the cutting wheels notched or scored has added importance. The drive wheels are not present, so the added gripping capabilities they provide would instead be provided by the cutting wheels. However, this is not essential, merely beneficial.

It will be apparent to those in the art that the cutting wheels 300, 301, and 302 can have sharpened, or knifelike, edges. This facilitates cutting. However, the risk of injury is greater due to the sharpness. In the preferred embodiment, the cutting wheels are not sharpened. Rather, the rigidity of the outer periphery is sufficient to cut plastic while maintaining safety.

Figure 6:
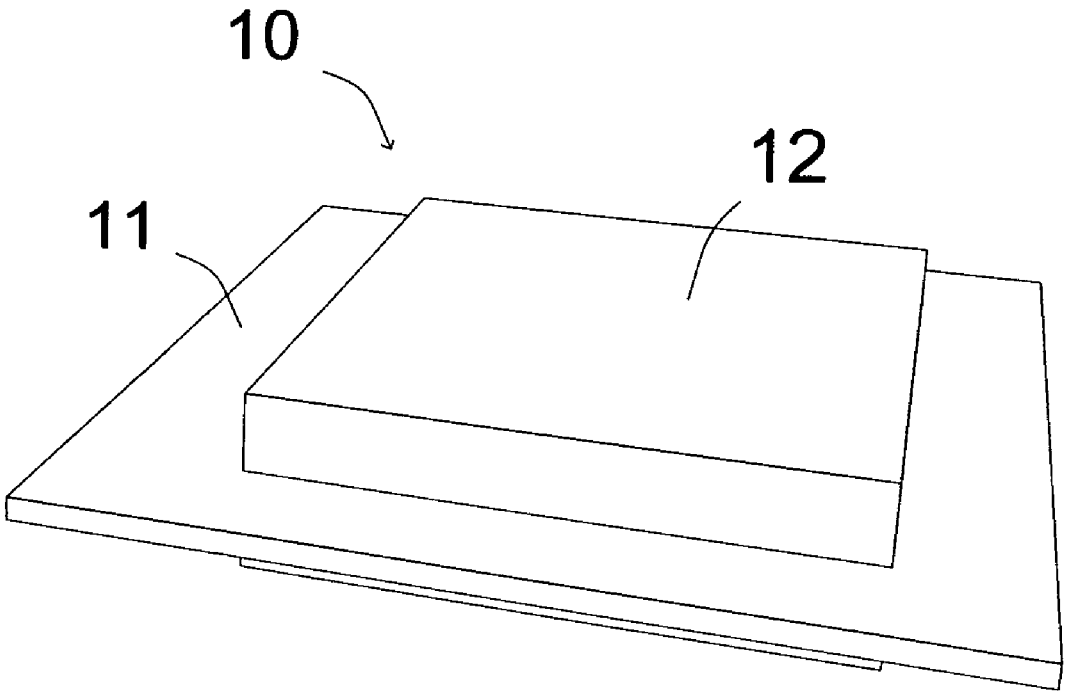
FIG. 6 is a perspective view of a typical plastic container.

The general operation, employing the various embodiments described, of the invention is as follows: FIG. 6 shows a typical plastic clamshell package 10 with container 12 and flange 11.

First and second support members 100, 200 are clamped about the flange of a plastic container such that the cutting wheels (with or without drive wheels) engage the flange. As clamping pressure is applied to the support members upon the flange, the cutting wheels engage the flange and lacerate it. The handle and second shaft are rotated. The cutting wheels and drive wheels, if used, engage the flange and help to pull the flange towards the cutting wheels. The user simply rotates the handle as the periphery of the flange is severed allowing for easily opening the package.

What is claimed is:

1. A cutting apparatus for easily opening plastic packaging comprising:

a first support member, said first support member being elongate and having proximal, distal, and middle portions, said first support member being substantially rigid, said first support member having an aperture in said middle portion;

a second support member, said second support member being elongate and having proximal, distal, and middle portions, said second support member being substantially rigid;

means for pivotably connecting said proximal portion of said second support member to said proximal portion of said first support member;

a second shaft, said second shaft being rigid, and elongate, said second shaft having a longitudinal axis through the center thereof, said second shaft having a proximal and a distal end, and a middle portion;

means for rotatably securing said middle portion of said second shaft within said aperture in said middle portion of said first support member;

a first cutting wheel, said first cutting wheel being disk shaped, rigid, and having a center portion, said first cutting wheel having a transverse axis through said center portion;

a second cutting wheel, said second cutting wheel being disk shaped, rigid, and having a center portion, said second cutting wheel having a transverse axis through said center portion;

a third cutting wheel, said third cutting wheel being disk shaped, rigid, and having a center portion, said third cutting wheel having a transverse axis through said center portion;

a handle, said handle being securedly attached to said distal end of said second shaft;

said first cutting wheel having a center portion being coaxially aligned with said longitudinal axis of said second shaft, and being securedly attached to said proximal end of said second shaft;

means for said second and third cutting wheels being in rotatable connection with said middle portion of said second support member;

whereby said first cutting wheel may engage said second cutting wheel and said third cutting wheel on opposite sides of the flange of a plastic container;

further whereby a plastic flange may be lacerated by rotating said first cutting wheel.

2. The apparatus of claim 1 further comprising:

a first drive wheel, said first drive wheel being disk shaped, rigid, and having a center portion, said first drive wheel having a transverse axis through said center portion;

a second drive wheel, said second drive wheel being disk shaped, rigid, and having a center portion, said second drive wheel having a transverse axis through said center portion;

said first cutting wheel, said first drive wheel, and said second drive wheel:

being coaxially aligned about their center portions, and being coaxially aligned with said longitudinal axis of said second shaft, and forming a combination by said first cutting wheel being sandwiched between said first and second drive wheels, said combination being securedly attached to said proximal end of said second shaft;

further whereby said first cutting wheel, said first drive wheel, and said second drive wheel may engage said second cutting wheel and said third cutting wheel on opposite sides of the flange of a plastic container;

further whereby a plastic flange may be lacerated by rotating said combination of said first cutting wheel, said first drive wheel, and said second drive wheel.

3. The apparatus of claim 2 further comprising:

said first drive wheel having a notched periphery, further whereby said first drive wheel may have increased frictional or gripping qualities.

4. The apparatus of claim 2 further comprising:

said second drive wheel having a notched periphery, further whereby said second drive wheel may have increased frictional or gripping qualities.

5. The apparatus of claim 1 further comprising:

said means for pivotably connecting said proximal portion of said second support member to said proximal portion of said first support member comprising, said proximal portion of said first support member having an aperture, said proximal portion of said second support member having an aperture, said apertures of said first and second proximal portions being coaxially aligned, a first shaft being positioned through said apertures of said first and second support members, further whereby said first and second support members are pivotably connected.

6. The apparatus of claim 1 further comprising:
said means for rotatably securing said middle portion of said second shaft within said aperture in said middle portion of said first support member comprising,
a firm, frictional fit.

7. The apparatus of claim 1 further comprising:
said means for rotatably securing said middle portion of said second shaft within said aperture in said middle portion of said first support member comprising,
an annular bearing assembly.

8. The apparatus of claim 1 further comprising:
the periphery of said first cutting wheel being sharpened.

9. The apparatus of claim 1 further comprising:
said first cutting wheel having a notched periphery,
further whereby said first cutting wheel may have increased frictional or gripping qualities.

10. The apparatus of claim 1 further comprising:
the periphery of said second cutting wheel being sharpened.

11. The apparatus of claim 1 further comprising:
said second cutting wheel having a notched periphery,
further whereby said second cutting wheel may have increased frictional or gripping qualities.

12. The apparatus of claim 1 further comprising:
the periphery of said third cutting wheel being sharpened.

13. The apparatus of claim 1 further comprising:
said third cutting wheel having a notched periphery,
further whereby said third cutting wheel may have increased frictional or gripping qualities.

14. The apparatus of claim 1 further comprising:
said means for said second and third cutting wheels being in rotatable connection with said middle portion of said second support member comprising,
a third shaft,
said third shaft being rigid and elongate,
said third shaft having a longitudinal axis through the center thereof,
said third shaft having a proximal and a distal end, and a middle portion,
said distal end of said third shaft being rotatably attached to said middle portion of said second support member,
said second cutting wheel and said third cutting wheel:
being securedly attached to said proximal end of said third shaft,
and being coaxially aligned about their center portions,
and being coaxially aligned with said longitudinal axis of said third shaft,
and being spaced apart from each other such that said first cutting wheel may fit therein.

15. The apparatus of claim 1 further comprising:
said means for said second and third cutting wheels being in rotatable connection with said middle portion of said second support member comprising,
a third shaft,
said third shaft being rigid and elongate,
said third shaft having a longitudinal axis through the center thereof,
said third shaft having a proximal and a distal end, and a middle portion,
said distal end of said third shaft being securedly attached to said middle portion of said second support member,
said second cutting wheel and said third cutting wheel:
being rotatably attached to said proximal end of said third shaft,
and being coaxially aligned about their center portions,
and being coaxially aligned with said longitudinal axis of said third shaft,
and being spaced apart from each other such that said first cutting wheel may fit therein.

16. A cutting apparatus for easily opening plastic packaging comprising:
a first support member,
said first support member being elongate and having proximal, distal, and middle portions,
said first support member being substantially rigid,
said first support member having an aperture in said middle portion;
a second support member,
said second support member being elongate and having proximal, distal, and middle portions,
said second support member being substantially rigid;
said proximal portion of said first support member having an aperture;
said proximal portion of said second support member having an aperture;
said apertures of said first and second proximal portions being coaxially aligned;
a first shaft being positioned through said apertures of said first and second support members thereby allowing said first and second support members to move pivotably with respect to each other;
a second shaft,
said second shaft being rigid, and elongate,
said second shaft having a longitudinal axis through the center thereof,
said second shaft having a proximal and a distal end, and a middle portion;
said middle portion of said second shaft being rotatably secured within said aperture in said middle portion of said first support member;
a first cutting wheel,
said first cutting wheel being disk shaped, rigid, and having a center portion,
said first cutting wheel having a transverse axis through said center portion;
a second cutting wheel,
said second cutting wheel being disk shaped, rigid, and having a center portion,
said second cutting wheel having a transverse axis through said center portion;
a third cutting wheel,
said third cutting wheel being disk shaped, rigid, and having a center portion,
said third cutting wheel having a transverse axis through said center portion;
a first drive wheel,
said first drive wheel being disk shaped, rigid, and having a center portion,
said first drive wheel having a transverse axis through said center portion,
said first drive wheel having a notched periphery,
whereby said first drive wheel may have increased frictional or gripping qualities;
a second drive wheel,
said second drive wheel being disk shaped, rigid, and having a center portion,
said second drive wheel having a transverse axis through said center portion, said second drive wheel having a notched periphery, whereby said second drive wheel may have increased frictional or gripping qualities;

a handle, said handle being securedly attached to said distal end of said second shaft;

said first cutting wheel, said first drive wheel, and said second drive wheel:

being coaxially aligned about their center portions, and being coaxially aligned with said longitudinal axis of said second shaft, and forming a combination by said first cutting wheel being sandwiched between said first and second drive wheels, said combination being securedly attached to said proximal end of said second shaft;

a third shaft, said third shaft being rigid and elongate, said third shaft having a longitudinal axis through the center thereof, said third shaft having a proximal and a distal end, and a middle portion, said distal end of said third shaft being securedly attached to said middle portion of said second support member;

said second cutting wheel and said third cutting wheel:

being rotatably attached to said proximal end of said third shaft, and being coaxially aligned about their center portions, and being coaxially aligned with said longitudinal axis of said third shaft, and being spaced apart from each other such that said first cutting wheel may fit therein;

whereby said first cutting wheel, said first drive wheel, and said second drive wheel may engage said second cutting wheel and said third cutting wheel on opposite sides of the flange of a plastic container;

further whereby a plastic flange may be lacerated by rotating said combination of said first cutting wheel, said first drive wheel, and said second drive wheel.

* * * * *